United States Patent [19]

Wallace

[11] 4,023,784

[45] May 17, 1977

[54] APPARATUS FOR FEEDING METAL SCRAP INTO MOLTEN METAL

[76] Inventor: Henry J. Wallace, 570 Squaw Run Road, Pittsburgh, Pa. 15238

[22] Filed: June 30, 1975

[21] Appl. No.: 591,451

Related U.S. Application Data

[60] Continuation-in-part of Ser. No. 535,444, Dec. 23, 1974, abandoned, which is a division of Ser. No. 403,842, Oct. 5, 1973, Pat. No. 3,871,058.

[52] U.S. Cl. ..... 266/216; 164/57; 198/564; 214/18.3; 266/901

[51] Int. Cl.[2] ..... C21C 7/00

[58] Field of Search ..... 164/57, 59, 76, 97; 266/34 T, 33 S, 216, 901; 198/128, 564, 642; 214/18 SC, 18.22, 18.3, 18.38

[56] References Cited

UNITED STATES PATENTS

| | | | |
|---|---|---|---|
| 2,073,792 | 3/1937 | Gray | 198/128 |
| 2,075,274 | 3/1937 | Darling | 214/18.3 |
| 2,136,214 | 11/1938 | Keith | 198/128 X |
| 2,361,836 | 10/1944 | Fulton | 214/18.3 |
| 2,872,180 | 2/1959 | Tietig, Jr. et al. | 260/34 T |
| 3,050,202 | 8/1962 | Funk | 214/18.38 |
| 3,080,158 | 3/1963 | Stenzel | 266/34 T |
| 3,429,361 | 2/1969 | Brooks | 164/57 |
| 3,758,267 | 9/1973 | Berk | 266/33 S |
| R21,617 | 11/1940 | Larsen | 198/128 X |

FOREIGN PATENTS OR APPLICATIONS

| | | | |
|---|---|---|---|
| 1,961,022 | 6/1971 | Germany | 266/183 |

*Primary Examiner*—Roy Lake
*Assistant Examiner*—Paul A. Bell
*Attorney, Agent, or Firm*—Martin J. Carroll

[57] ABSTRACT

Apparatus for feeding small pieces of metal scrap into a mold while molten metal of the same or similar analysis is being poured includes means for heating the scrap, a chute for feeding scrap to the mold and means for positively feeding the heated scrap at a controlled rate to the chute.

Heated and clean scrap is thrown by a throwing machine at a controlled velocity through a closed chute into the mold. Means may be provided to change the angle of discharge of scrap into the mold. Scrap may be fed to the throwing machine from a vibratory feeder which controls the rate of feed and receives the scrap from a hopper. The vibratory feeder may be omitted and a plurality of compartments may be provided in the hopper. Individual control of flow of scrap from each compartment controls the rate of scrap feed. The velocity of the scrap is sufficient to enable it to penetrate into the molten metal.

11 Claims, 8 Drawing Figures

VI
VI
38
38
60
60
34
36
36
44
52
72
91
40
40
62
64
98
98
104
100
108
112
110
106
102
96
94
116
124
124
138
140
140
120
122
130
128
120
132
136
136
134
96
130
120
122
94
92
120
130
120
122
128
60

APPARATUS FOR FEEDING METAL SCRAP INTO MOLTEN METAL

This application is a continuation-in-part of my copending application Ser. No. 535,444 now abandoned, filed Dec. 23, 1974, which in turn is a division of my application Ser. No. 403,842, filed Oct. 5, 1973, now U.S. Pat. No. 3,871,058 dated Mar. 18, 1975.

This invention relates to a method and apparatus for making metal products, an example of which is the manufacture of steel sheets from pieces of sheet steel scrap added to molten steel while being poured into an ingot mold. The rapid growth in the use of oxygen converters for making steel, replacing open hearth furnaces, has created an excess of steel scrap because the oxygen converter has definite limits on the percentage of scrap which can be used, in contrast to the open hearth furnace which has no such limits. The scrap generated in steelmaking plants and in steel users fabricating operations is an excellent source of metallics of known analysis, and steel companies have for many years sought ways of best utilizing larger proportions of this scrap than are normal to the oxygen converter process. All of the methods now in common use, require complete remelting of scrap, with the attendant high cost of facilities and operations and environmental controls. I have found that when steel scrap of known analysis is properly sized, cleaned and heated only sufficiently to remove the moisture therefrom, fed to an ingot mold along with molten steel of a similar analysis in an amount such that the majority thereof will not melt in the mold, and the resulting ingot processed in the usual manner to obtain sheets, the resulting steel is of such quality that it can be used for many products in the same manner as standard sheets.

In an effort to avoid the necessity of melting scrap, it has been suggested and tried to assemble pieces of scrap in various ways, then heat them to rolling temperature, and then roll on conventional rolling equipment, but these processes proved to be uneconomical and unsatisfactory.

While it is known to add solids to castings, this has been done for other reasons than to utilize scrap. The closest art of which I have knowledge are Fromson Pat. No. 2,855,646 dated Oct. 14, 1958 and Brooks Pat. No. 3,429,361 dated Feb. 25, 1969. In Fromson, shot is made from a portion of a batch of molten metal and then fed as a solid along with the remaining molten metal to a mold. The temperature and volume are controlled so that there is "a total amount of heat in the mixture which will cause at least an incipient fusion of the solid particles in the mixture." The process was developed to control temperature inside a casting while pouring the casting and is more expensive than standard casting procedure. The basic method and purpose of the Brooks patent is similar to that of Fromson's in that it represents an approach to controlling temperature inside a continuous casting mold while pouring. The amount of heat in a normal mold of molten steel is not sufficient to melt the majority of the scrap which I add, but I have found that this is not necessary. My process does not require special temperature control or special rolling practices.

Stenzel U.S. Pat. No. 3,080,158 dated Mar. 5, 1963, and Tietig U.S. Pat. No. 2,872,180, dated Feb. 3, 1950 disclose apparatus for adding the usual solids to hot metal ladles. These solids are not heated and form a very minor part of the mixture so that the problems involved are much different and less severe than when feeding metal scrap in large quantities. The machines while satisfatory for their intended purpose are not satisfactory for applicant's purpose.

While any means for feeding the scrap positively may be used I prefer to use such means which will feed the scrap at high speeds so that the scrap will mix better with the molten metal.

It is therefore an object of my invention to provide apparatus suitable for feeding scrap into a mold at the same time as molten metal is teemed.

Another object is to provide such apparatus which feeds the scrap at high speeds.

A further object is to provide such apparatus which feeds the scrap without danger of injuring workmen.

These and other objects will become more apparent after referring to the following specification and drawing, in which.

Figure 1:
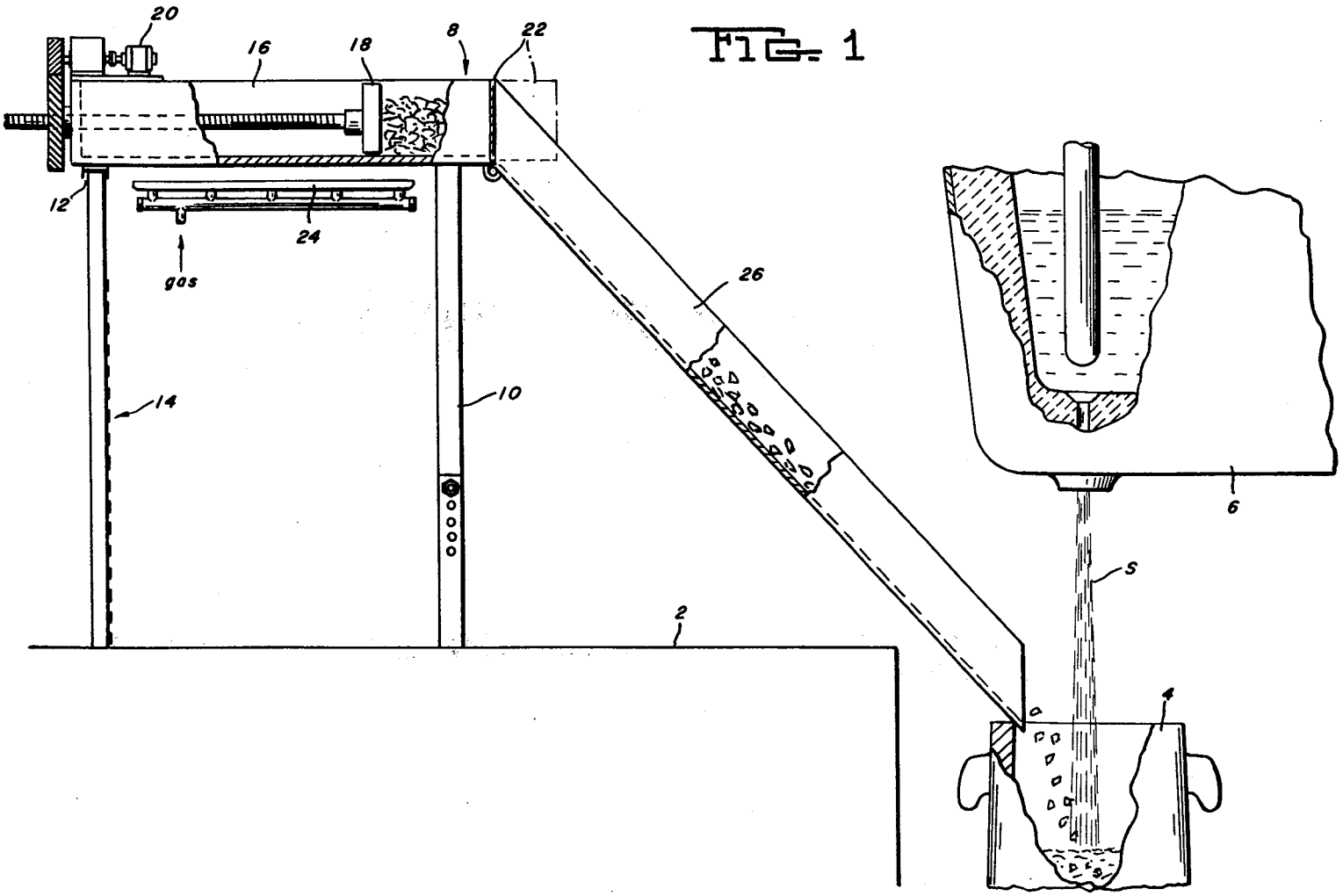
FIG. 1 is an elevation, partly in section, showing one embodiment of my invention.

Referring more particularly to the drawing, reference numeral 2 indicates a teeming floor with a commercial size ingot mold 4 and ladle 6 positioned adjacent thereto in the usual manner. According to one embodiment of my invention, a scrap feeder 8 is supported above floor 2 in any suitable manner such as by means of front legs 10 and H-beam 12 of safety shield 14. The feeder 8 includes a rectangular shaped cylinder 16 open at its top and having a movable plunger 18 therein. A motor 20 moves the plunger 18 the length of the cylinder 16. The forward end of the cylinder 16 is closed by means of a pivoted gate 22. Gas burners 24 are positioned below the cylinder 16. A chute 26 is attached to the forward end of cylinder 16. In one particular installation, the chute is adjustable between 11 feet and 13 feet 10 inches, has a width of 12¼ inches and a depth of 12 inches; and the cylinder 16 has a length of 9 feet 8 inches, a width of 14¼ inches and a depth of 15 inches.

In operation, a heat of molten metal of the desired composition is selected and scrap having an analysis approaching that of the molten metal is provided. Since the invention is particularly suitable and desirable for making rolled steel products, the molten metal is preferably provided from a low carbon aluminum-killed steel heat which has a finishing bath temperature between 2860° and 2880° F, and a ladle temperature between 2845° and 2865° F. While it is preferable that the scrap analysis be the same as that of the hot metal, the invention may be practiced by using scrap of an analysis that differs somewhat from that of the hot metal as long as the scrap has similar physical properties as the steel of the heat. The scrap is cut into relatively small pieces. For example, pieces 2 × 2 × 0.024 inch thick are suitable. The scrap must be cleaned before use to remove all of the oil, grease, dirt and rust therefrom. The scrap feeder 8 is positioned as shown with the back end clamped to beam 12 and the two front legs 10 resting on the floor 2. With the plunger 18 at its back position, the cylinder 16 is filled uniformly with the desired weight of scrap. The plunger 18 is then moved forward to compress the scrap as much as possible to facilitate heating. The burners 24 are then lit and the scrap heated to remove the moisture therefrom. To insure that all the moisture is removed in a relatively short time, the scrap is preferably heated to a temperature between 400° and 500° F. With the mold 4 positioned directly in front of feeder 8, the chute 26 is attached to the forward or discharge end of cylinder 16 with its length adjusted so that the lower end will extend into the mold cavity. The ladle 6 containing the molten metal is then positioned above the mold 4 and the metal poured in the usual manner in a steam S. At the same time, gate 22 is pivoted out of operative position to the broken line position shown and the motor 20 is operated to move plunger 18 forward at a controlled rate to feed the scrap into mold 4 with the molten metal stream S. It will be seen that the scrap is directed into the falling metal stream S adjacent the top of the mold to provide best distribution of the scrap.

The percentage of scrap may vary, but it is not intended that the scrap melt. While obviously there will be some melting of the scrap, the majority thereof will not melt, but will be completely encased in the molten steel as it solidifies in the mold.

When using 24 × 37 ×]85 inch molds, 1,330 pounds of scrap may be added to 14,670 pounds of molten steel so that the scrap is 8.3% of the total weight of the ingot or 2,600 pounds of scrap may be added so that the scrap is 16.7% of the total weight of the ingot. In the first instance, the scrap is added at a steady rate for a total period of 30 seconds and in the second instance, for a total period of 25 seconds. The amount of scrap added should be a minimum of 5% of the total weight of the ingot, but may be as high as 50%.

The steel is then permitted to solidify sufficiently to handle, removed from the mold, and placed in a soaking pit to heat it throughout to its rolling temperature and then rolled into slabs in the usual manner. During this rolling operation in which the cross section is reduced a minimum of 75% the pieces of scrap are pressure welded and bonded to each other and to the steel of the heat. The slabs are then heated and rolled into other products, such as hot rolled sheet steel, in the usual manner. The resulting steel product has surface characteristics and physical properties making it suitable for a wide range of end uses.

I have found that sheet steel scrap material having a maximum thickness of 0.025 inches, a minimum dimension of 1 inch, and a maximum dimension of 4 inches is particularly suitable. This sheet material includes hot and cold rolled sheet and strip and black plate. It is also preferred that the pieces be of substantially uniform size. If other types of scrap are used, the maximum dimension should preferably not exceed 4 inches. It appears that scrap additions of between 10 and 20% are most suitable. Depending upon the price and availability of scrap, percentage additions under 10% may not be economically justified. Percentage additions over 20% may require heating of the scrap to temperatures substantially above 500° F and create problems in handling and adding the scrap to the molten steel.

I have found that the rolled steel product, especially in sheet form, consists of a mass of steel having a plurality of small steel scrap pieces interspersed in and bonded thereto. Because of the scrap additions, there is random grain orientation. The physical properties of the product are comparable to those of similar conventional steel products.

Figures 2, 4:
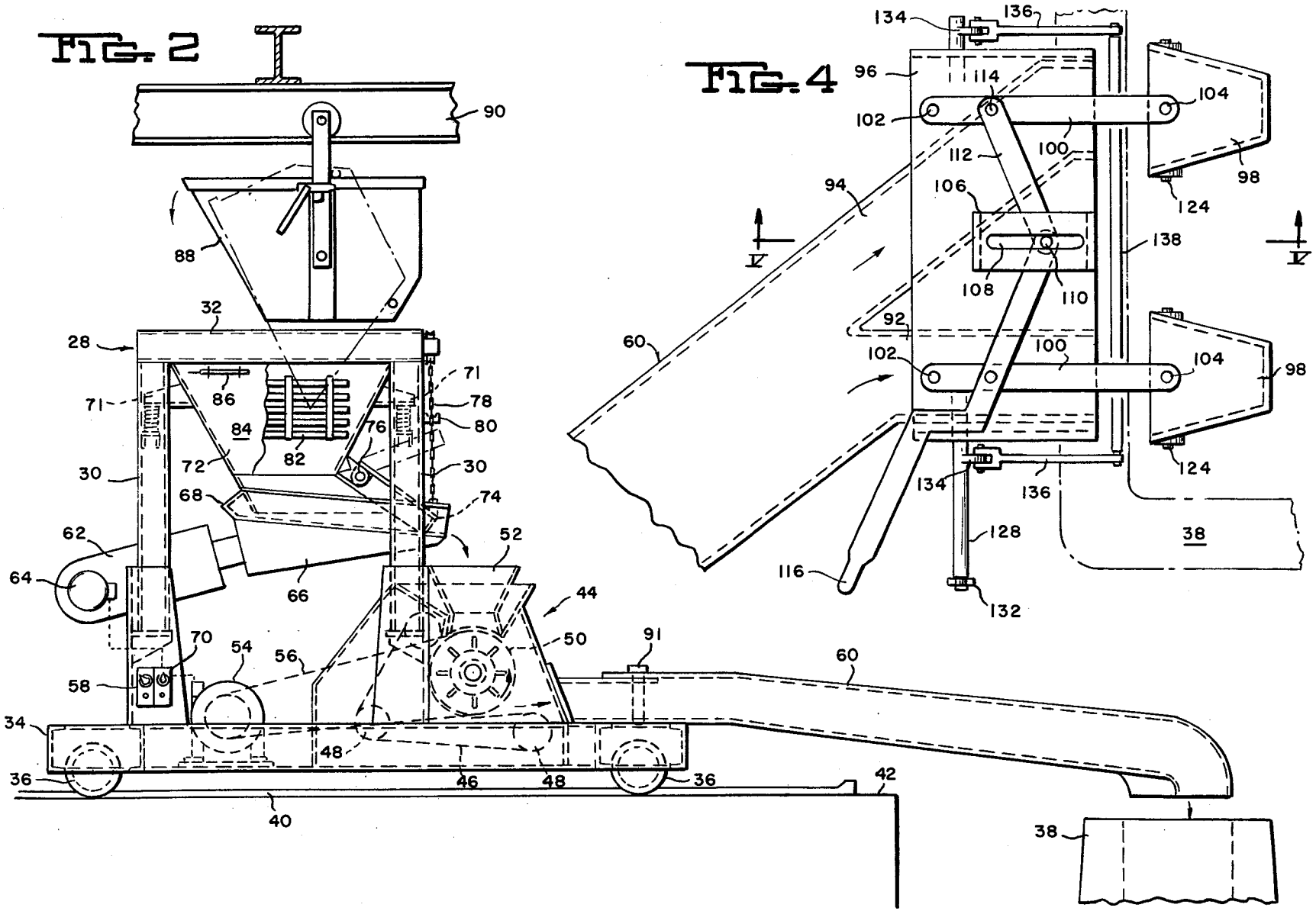
FIG. 2 is a view, similar to FIG. 1, showing a second embodiment of my invention.
FIG. 4 is a plan view showing a modified end of the scrap chute.
Figures 3, 5, 6:
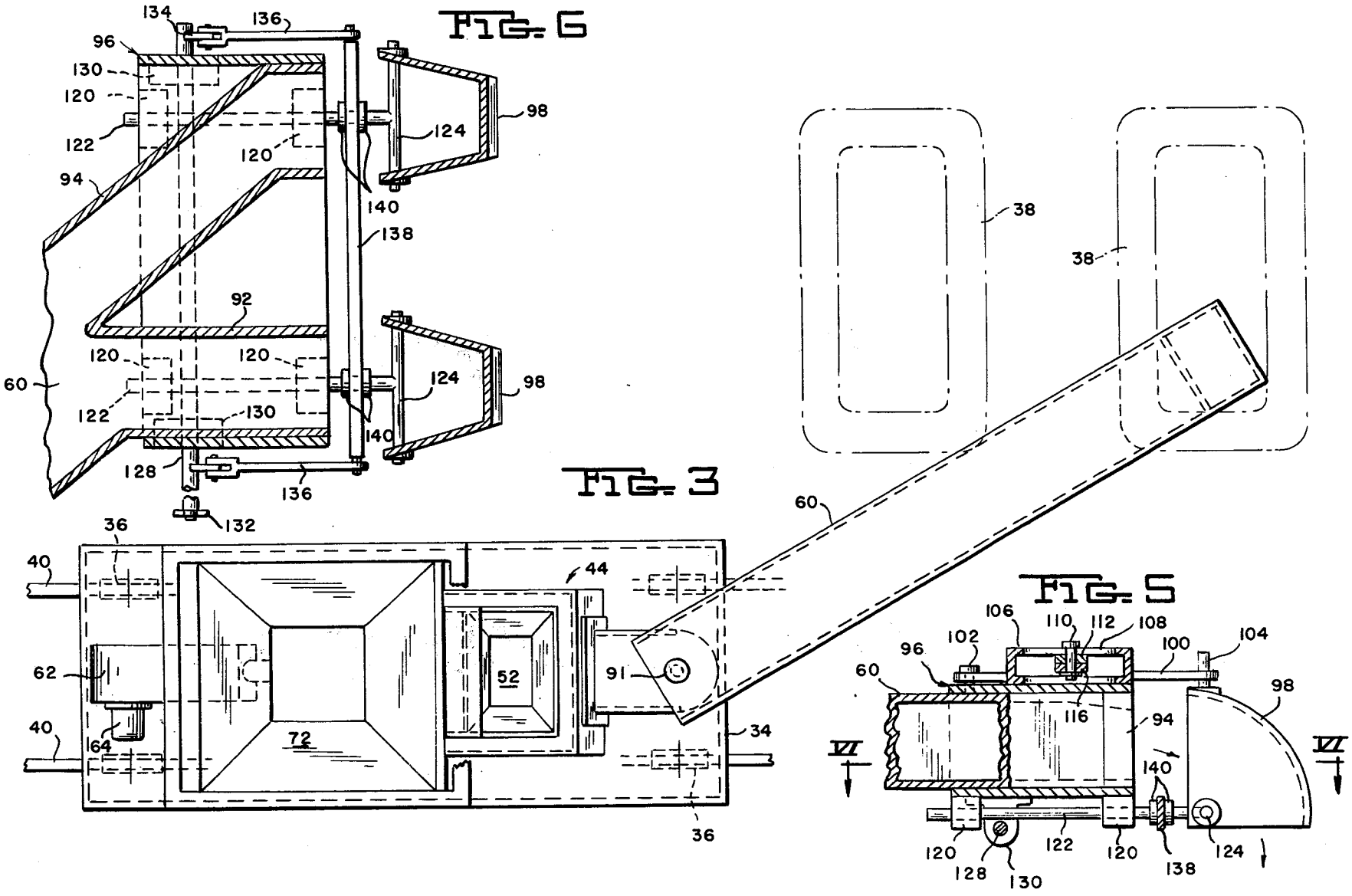
FIG. 3 is a plan view of FIG. 2 with upper parts removed.
FIG. 5 is a view taken on the line V—V of FIG. 4.
FIG. 6 is a view taken on the line VI—VI of FIG. 5.
Figure 7:
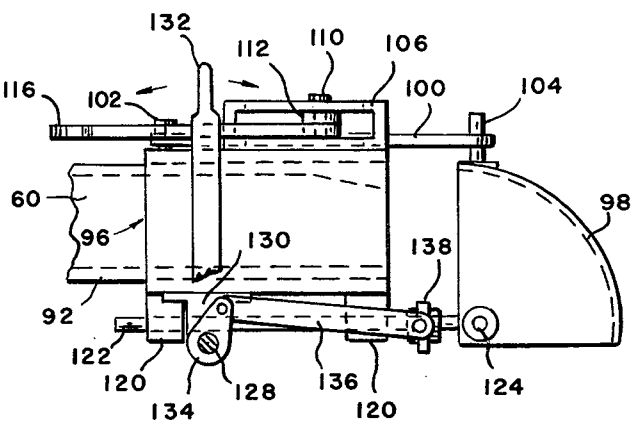
FIG. 7 is a side elevation of FIG. 4.

FIGS. 2 to 7 show a second and more sophisticated embodiment of my invention, which is suitable for adding scrap under more diversified conditions. In this embodiment reference numeral 28 represents a supporting structure made up of vertical columns 30 connected by horizontal beams 32. The columns and beams as shown are 4 × 6 in. tubing. The bottom of structure 28 is shown as being a carriage 34 mounted on wheels 36. When adding scrap to a plurality of ingot molds 38, as shown in FIGS. 2 and 3, the carriage 34 is mounted on rails 40 provided on pouring floor 42. A standard throwing mechanism 44 is mounted on carriage 34. As shown, this may be a Blaw-Knox Dolomite Machine, as shown on Page 1 of their Bulletin 2421 copyrighted in 1953 by the Blaw-Knox Co. This mechanism includes a belt 46 passing around idler pulleys 48 and a grooved throwing wheel 50. Scrap is fed to the wheel 50 through a hopper 52. As shown, the wheel 50 is driven from a motor 54 by means of belt 56. In one installation motor 54 is a 20-horsepower, 250 volt D.C. motor. A control 58 varies the speed of the motor between 850 and 2200 R.P.M. so that the velocity of the scrap leaving the throwing mechanism and delivered to a closed chute 60 will be between 1100 and 3300 ft. per minute. Details of the chute will be described later.

A standard vibratory feeder 62, such as a SYNTRON No. F440, is mounted above the thrower 44. This includes a motor 64 and a vibrating pan 66 mounted on a support 68. A control 70 for motor 64 determines the rate of feed and also enables the feed to be shut off quickly. The feeder 62 is supported on columns 30 by means of a spring biased supporting hanger 71 at each corner thereof. Up to 6000 lbs. of scrap per minute may be fed by the vibrator 62 from its pan 68 to hopper 52.

A hopper 72 is mounted at the top of supporting structure 28 with its bottom open to the pan 68. A gate 74 pivoted at 76 to hopper 72 is closed during loading of hopper 72 and is raised by means of chain 78 and held in raised position by means of hook 80 so as to permit discharge of the scrap into hopper 52. An electric heating system 82 is provided on the outside of all four sides of hopper 72. Insulation 84 covers all four sides of hopper 72 on the outside of the heating system. A thermostatic control 86 is preferably provided for the heating system. The hopper 72 may be loaded with scrap in any well-known manner. As shown, it is fed from a tip-over self-righting type bucket 88 mounted on rail 90. It is preferred that the hopper 72 be readily removable from supporting structure and that a plurality of such hoppers be provided for a purpose which will appear later.

The chute 60 is mounted for movement on a vertical pivot 91. While the discharge end of chute 60 may be a plain open end as shown in FIG. 2, it is preferred that means be provided to split the stream of scrap in half and also to direct the scrap downward at adjustable angles to the vertical so that it will impinge on the falling stream of molten metal at various vertical locations. One structure for accomplishing this is shown in FIGS. 4 to 7. The discharge end of chute 60 is divided into passageways 92 and 94 and a housing 96 is welded or otherwise fastened to and surrounds the bifurcated ends thereof. If desired, a baffle plate may be pivotally mounted at the forward junction of passageways 92 and 94 and extended toward the entry end of chute 60 in order to insure equal distribution of the scrap into the two streams. By moving the baffle plate, equal distribution can be obtained regardless of the velocity and amount of scrap being fed. A scrap guide 98 is positioned at the end of each passageway 92 and 94. Each guide 98 is generally triangular in vertical section with its hypotenuse having an arcuate inside surface and each leg being open. The one leg is substantially vertical to receive scrap from its associated passageway and the other leg substantially horizontal to discharge scrap downwardly into the mold. Each guide 98 is supported by a link 100 having one end pivotally connected at 102 to housing 96 and its other end pivotally connected at 104 to guide 98. A U-shaped bracket 106 is secured to the top of housing 96 between links 100 and has a slot 108 therein for receiving a pin 110. A link 112 has one end pivotally connected to pin 110 and its other end pivotally connected at 114 to one of the links 100. A hand lever 116 has one end pivotally connected to pin 110 and is pivotally connected intermediate its ends to the other link 100. A pair of brackets 120 are secured to each end of the bottom of housing 96 in alignment with the centers of guides 98. A rod 122 is slidably received in each pair of brackets 120. A rod 124 passes through each guide 98 adjacent the lower end thereof. The rod 122 is welded to rod 124 midway of its ends. A rod 128 is mounted for rotation in bearings 130 secured to the bottom of housing 96. The rod 128 is rotated by means of hand lever 132 secured thereto. One end of a link 134 is secured to each end of rod 128 for movement therewith with its other end pivotally connected to one end of an associated link 136. A bar 138 extends between and is fastened to the free ends of links 136 and is provided with openings for receiving rods 122. Collars 140 on rods 122 on each side of bar 138 cause the rods 122 to be moved by bar 138.

Due to various factors, such as the size of the mold, the height of the molten metal in the mold, etc., it may be desired to change the angle of discharge of the scrap. This is accomplished by the above structure either before feeding of the molten metal and scrap or during such feeding in the following manner. Movement of hand lever 116 counter-clockwise as shown in FIG. 4 will cause the ends of levers 100 carrying the guides 98 to move apart. Since the bottom of guides 98 are confined by rods 122 this causes the guides 98 to tilt in such a direction that the two streams of scrap will tend to converge. Movement in the opposite direction will cause the streams to diverge. Movement of hand lever 132 clockwise in FIG. 7 will cause the rod 124 and the bottom of guide 98 to move to the right. This will cause the streams of scrap to discharge more toward the right side of the mold 38 as shown in FIG. 4. Movement of hand lever 132 in the opposite direction will cause discharge more toward the left side of the mold 38. It will be noted that the various connections to the guides 98 are sloppy to permit the movements set forth above.

In operation, when charging a plurality of individual ingot molds 38 as shown in FIGS. 2 and 3 the supporting structure 28 is moved along tracks 40 and the chute 60 pivoted into position over the first mold to be filled. The levers 116 and 132 are manipulated to direct the scrap feed as desired. The cleaned scrap is heated to the required temperature in hopper 72 to remove the moisture therefrom. The gate 74 is raised and the control 58 set to cause the thrower 44 to operate at the selected speed most suitable for the particular conditions. When teeming of the hot metal starts the control 70 is operated to cause the feeder 62 to feed the scrap at the desired rate (pounds per minute) to the thrower 44 so that it is fed along with the molten metal into the selected mold 38. In case the feed of the molten metal is stopped for any reason, feed of scrap is immediately stopped by operation of control 70. Throwing the scrap into the mold at a relatively high speed insures that it will penetrate the molten metal already in the mold rather than floating on top. The levers 116 and 132 may be operated during pouring to change the angle of discharge of the scrap into the mold. After the mold is filled flow of hot metal and scrap is stopped and the ladle of hot metal and supporting structure 28 are moved into position to fill another mold 38 and the process is repeated. The hopper 72 may be made sufficiently large to contain enough scrap for the entire charge in the ladle or a plurality of replaceable hoppers 72 may be provided with the scrap being heated in the hoppers in another location. It is then only necessary to replace an exhausted hopper with a filled hopper. By filling the hopper with just enough scrap to be fed to one mold the replacement can be made while moving the ladle and scrap feeder to another mold. Another manner of operation is to heat the scrap at another location and pour the heated scrap into hopper 72 on structure 28. When the ingot mold is a continuous mold it will usually be necessary to have replaceable hoppers or means to heat the scrap at another location for charging into the hopper. While it is desirable to feed the scrap uninterrupted, there is no loss in quality when pouring of the hot metal proceeds without feeding of scrap. This, however, reduces the percentage of scrap which can be added.

While the scrap charger is shown mounted on wheels supported on a platform, it will be understood that it could be suspended from a crane or even be mounted stationary as when feeding into a continuous mold.

Figure 8:
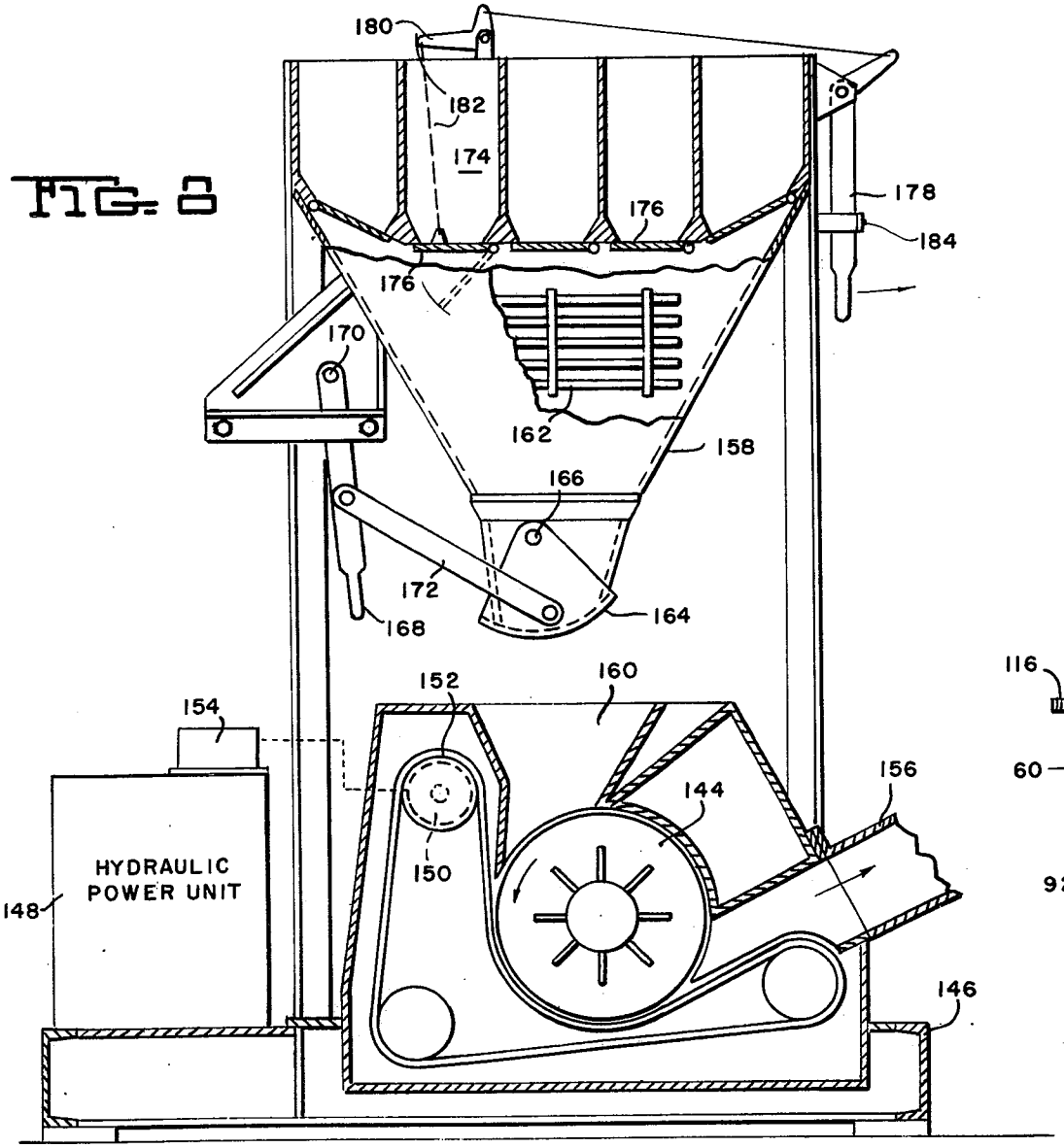
FIG. 8 is a view, similar to FIG. 2, showing another embodiment of my invention.

FIG. 8 shows a third embodiment of my invention which is less expensive than the second embodiment, but which is suitable for many purposes, especially in smaller shops. It is also suitable for carrying out experimental work to determine design characteristics for machines for a large shop.

In this embodiment a throwing mechanism 144, similar to, but smaller than, throwing mechanism 44, is mounted on a supporting structure 146. A hydraulic power unit 148 is mounted adjacent mechanism 144 and the mechanism 144 is operated by a hydraulic motor 150 which drives pulley 152. A control 154 starts and stops motor 150 and controls its speed and hence the velocity of scrap fed to chute 156. A hopper 158 is mounted on structure 146 above hopper 160 of throwing mechanism 144. Heating elements 162 are provided around the outside of hopper 158 as in the second embodiment. The bottom of hopper 158 is provided with a closure 164 which is pivotally mounted at 166 and is movable between open and closed positions by means of lever arm 168 which is pivotally mounted at 170. A link 172 has its ends pivotally connected to closure 164 and lever arm 168. The lever arm 168 may be frictionally held in adjusted position or other means such as a pin and holes may be provided for this purpose. The top of hopper 158 is provided with a plurality of compartments 174. A pivotally mounted gate 176 is provided at the bottom of each compartment 174 and is movable by a lever arm 178 connected to link 180 which in turn is connected to gate 176 by wire rope 182. Lever arm is locked in position by bracket 184.

In operation, the assembly is positioned in the desired location in any suitable manner. Scrap is loaded into one or more of the compartments 174 and/or in the main portion of the bin 158. The amount of scrap in each compartment and main portion of the bin is weighed prior to loading. In carrying out experimental work to determine how much scrap should be added to a particular casting the amount can be varied from a small amount in the main portion of the bin to an amount which completely fills the bin including the compartments 174. Assuming that the maximum amount is to be added the chute 156 is positioned to discharge scrap into the mold and the control 154 is actuated to cause the throwing mechanism 144 to throw scrap at the desired velocity. The closure 164 is then opened to discharge the scrap from the main portion of hopper 158 into hopper 160 after which it may be closed and the gate 176 of the compartments opened to discharge its scrap into the main portion of the hopper. When the initial scrap has been thrown from the throwing mechanism 144 the operator opens closure 164. This is repeated until all the scrap has been fed to the mold. In some instances the closure 164 may remain open and the scrap from each compartment fed directly into hopper 160. It will be seen that the operator controls the rate of feed by opening the gates 176 at desired intervals.

While several embodiments of my invention have been shown and described, it will be apparent that other adaptations and modifications may be made without departing from the scope of the following claims.

I claim:

1. Apparatus for feeding small pieces of metal into a container while molten metal is being supplied to said container which comprises a supporting structure, a hopper for said pieces mounted on said supporting structure, a throwing mechanism for said pieces mounted on said supporting structure, a feeder mounted on said supporting structure below said hopper and above said throwing mechanism and adapted to receive said pieces from said hopper and feed them at a controlled rate to said throwing mechanism, and a chute closed around its periphery and adapted to receive said pieces from said throwing mechanism and feed them into said container, said chute comprising at its discharge end means for directing said pieces generally downwardly into said container, said pieces being fed to said container at a controlled rate and speed such that the velocity of said pieces is sufficient to enable penetration of the molten metal in said container.

2. Apparatus according to claim 1 including means for varying the angle of discharge of said pieces from said chute.

3. Apparatus according to claim 1 including means for separating flow of said pieces in said chute into two streams, and means for varying the angle of discharge of said streams.

4. Apparatus according to claim 3 in which said small pieces are metal scrap and said apparatus includes means for heating said scrap prior to feeding it to said throwing mechanism.

5. Apparatus according to claim 1 in which said feeder is a vibratory feeder.

6. Apparatus according to claim 5 including means for varying the angle of discharge of said pieces from said chute.

7. Apparatus according to claim 5 including means for separating flow of said pieces in said chute into two streams, and means for varying the angle of discharge of said streams.

8. Apparatus according to claim 1 including means mounting said chute on said framework for movement about a vertical axis.

9. Apparatus according to claim 8 in which said feeder is a vibratory feeder.

10. Apparatus according to claim 9 including means for varying the angle of discharge of said pieces from said chute.

11. Apparatus according to claim 9 including means for separating flow of said pieces in said chute into two streams, and means for varying the angle of discharge of said streams.

* * * * *